US005838095A

United States Patent [19]

Tanaka et al.

[11] Patent Number: 5,838,095

[45] Date of Patent: Nov. 17, 1998

[54] FIELD EMISSION DISPLAY

[75] Inventors: Mitsuru Tanaka; Kazuyuki Yano, both of Mobara, Japan

[73] Assignee: Futaba Denshi Kogyo K.K., Mobara, Japan

[21] Appl. No.: 719,874

[22] Filed: Sep. 25, 1996

[30] Foreign Application Priority Data

Sep. 26, 1995 [JP] Japan ..... 7-270737

[51] Int. Cl.[6] ..... H01J 1/02

[52] U.S. Cl. ..... 313/309; 313/495; 313/497

[58] Field of Search ..... 313/495, 496, 313/497, 307, 309

[56] References Cited

U.S. PATENT DOCUMENTS 5,541,466 7/1996 Taylor et al. ..... 313/309
5,548,181 8/1996 Jones ..... 313/309
5,548,185 8/1996 Kummar et al. ..... 313/497
5,561,340 10/1996 Jin et al. ..... 313/309

*Primary Examiner*—Max H. Noori
*Attorney, Agent, or Firm*—Oblon, Spivak, McClelland, Maier & Neustadt, P.C.

[57] ABSTRACT

A field emission display for reducing luminance unevenness by construction means. A plurality of stripe shaped cathode wirings 102 are formed in the cathode area 109 on a cathode substrate 101. Cut-through sections 108 are formed in each of the cathode wirings 102 and an island-like electrode 107 is formed within each cut-through section 108. A resistance layer 103 is formed on the cathode wiring 102, the cut-through section 108 and the island-like electrode 107. A plurality of emitter cones 106 are formed on the resistance layer 103 so as to provide a field emission array. The distance between the island-like electrode 107 and the cathode wiring 102 is changed depending on the position thereof in the cathode area 109 so as to correct deviation of the emission characteristic depending on the position. In the case of a full-color field emission display, white balance can be corrected by changing the distance depending on the luminous color of each dot.

3 Claims, 7 Drawing Sheets

106
φ
t
Re1 (CONE RESISTANCE)

L
t
p
Re2 (ISLAND RESISTANCE)
Re = (Re1/ntip)+Re2
(SERIES EQUIVALENT RESISTANCE)

a
b
p
102
108
107
103

103
106
t
102
Re2
107
Re1
p

FIELD EMISSION DISPLAY

BACKGROUND OF THE INVENTION

1. Field of the Invention

This invention relates to a field emission display using a field emission array as its electron source.

2. Description of the Related Art

Recently, semiconductor fine structure processing technology has realized a micron size field emission cathode (FEC) which is formed on a substrate in the form of an array for use as a plane emission type electron source. Then, field emission displays using this as an electron source have been being developed.

As an example of such an FEC array, FIG. 1A shows the sectional view of an FEC array having a cathode electrode called island-like cathode and FIG. 1B shows its cathode electrode portion. In these Figures, reference numeral 101 denotes an insulating cathode substrate made of glass or the like and numeral 102 denotes one of stripe shaped cathode wirings which are disposed in plurality on the cathode substrate 101 in parallel to each other. As shown in FIG. 1B, a cut-through section 108 having no conductive substance is provided within the cathode wiring 102 and an island-like electrode 107 is disposed separately from the cathode wiring 102 inside of the cut-through section 108. Then, a resistance layer 103 is formed above the cathode wiring 102, the cut-through section 108 and the island-like electrode 107, and the island-like electrode 107 is electrically connected to the cathode wiring 102 by means of the resistance layer 103. A plurality of emitter cones 106 are formed above the resistance layer 103 corresponding to the island-like electrode 107. An insulating layer 104 made of silicone dioxide ($SiO_2$) is formed in an area where the emitter cones 106 are not formed on the resistance layer 103 and a gate electrode 105 is formed on the insulating layer 104. This gate electrode 105 is formed in the form of a stripe in a direction perpendicular to the cathode wiring 102.

According to this construction, a distance between the emitter cone 106 and the gate electrode 105 can be adjusted to the level of sub-microns. Thus, by only applying a gate-emitter voltage of several tens volts between the emitter cone 106 and the gate electrode 105, electron field emission can be achieved. Further, because a pitch between the emitter cones 106 can be about 5 to 10 $\mu$m, it is possible to form several ten thousand to several hundred thousand pieces of the FECs on a single cathode substrate 101.

Then, an anode substrate made of transparent glass or the like is disposed on the aforementioned cathode substrate 101 opposite thereto with a predetermined gap and an anode electrode coated with phosphor layer is formed on the anode substrate. By applying positive anode voltage to the anode electrode, electrons emitted from the emitter cone 106 are attracted to the anode electrode. Electrons strike the phosphor coated on the appropriate anode electrode so as to make the appropriate phosphor emit light. The field emission display (FED) is constructed as mentioned above. At this time, an FEC array substantially consisting of a plurality of the emitter cones 106 formed above one or a plurality of the island-like electrodes 107 corresponds to a single picture element.

The reason why the resistance layer 103 is disposed between the emitter cone 106 and the cathode wiring 102/the island-like electrode 107 is as follows.

That is, because a distance between the emitter cone and the gate electrode is very short, a short circuit may sometimes occur between the emitter cone and the gate electrode due to dust or the like in its production process. If there exists only a short circuit between the gate electrode and the emitter cone, no voltage is applied between any gate electrode and emitter cone. Thus, the operation of this system is made impossible.

Further, gas is locally produced at the initial operation of the FEC, so that this gas sometimes induces a discharge between the emitter cone and the gate electrode or the anode electrode. Consequently, this large current flows to the cathode thereby sometimes damaging the cathode.

Further, of a number of the emitter cones, electron discharge is concentrated on an emitter cone likely to emit electrons. Thus, current is concentrated on that emitter cone, so that an abnormally bright spot is sometimes produced on a screen.

For this reason, the resistance layer 103 is disposed between the emitter cone 106 and the cathode wiring 102. If the number of electrons discharged from an emitter cone 106 increases, the aforementioned resistance layer 103 reduces a voltage applied thereto so as to restrict the electron discharge from that emitter cone 106, in parallel to an increase of current flowing to the emitter cone 106. As a result, it is possible to prevent a runaway of the electron discharge from that emitter cone 106. As mentioned above, it is possible to prevent a concentration of current on a specific emitter cone 106 by providing the resistance layer 103, thereby improving FEC production yield and securing stable operation.

Further, if the emitter cones 106 are disposed on the resistance layer 103 without a provision of the island-like electrode, the value of resistance between the cathode wiring 102 and each of the emitter cones 106 differs depending on a distance between the cathode wiring 102 and each of the emitter cones 106. That is, an emitter cone formed near the cathode wiring 102 is subjected to a low resistance and an emitter cone formed in the center portion of its emitter cone group, away from the cathode wiring 102 is subjected to a high resistance. Thus, the amount of electron emission from an emitter cone 106 subjected to a low resistance located in the vicinity of the cathode wiring 102 increases but the amount of electron emission from an emitter cone 106 located in the center of the emitter cone group decreases, so that the amount of electron emission become uneven.

Then, the cut-through section 108 is formed in the area of the cathode wiring 102 and the island-like electrode 107 separated from the cathode wiring 102 is formed therein. And the emitter cone 106 is formed above a portion corresponding to the island-like electrode 107. As a result, the value of resistance between the cathode wiring 102 and each emitter cone 106 can be made uniform so that the amount of emission from the respective emitter cones can be made uniform.

FIG. 2 shows a top view of a cathode substrate 101 of the FED utilizing such an island construction cathode. As shown in this Figure, a cathode area 109 corresponding to a display area is formed on a cathode substrate 101 and as described above, stripe shaped cathode wirings 102 are formed on the entire surface of the cathode area 109. As mentioned previously, cut-through sections 108 are provided in the area of the cathode wiring 102 and an island-like electrode 107 is formed in the cut-through section 108. The cathode wiring 102 is electrically connected to the island-like electrode 107 through the aforementioned resistance layer 103 formed in the cut-through section 108.

In any place of the cathode area 109, the cathode wirings 102, the cut-through sections 108 and the island-like electrodes 107 are formed with the same dimensions and sizes respectively on the cathode area 109. That is, as shown in this Figure, at any place of the top left portion (1), the central portion (2) or the bottom right portion (3) of the cathode area 109, the cut-through sections 108 are formed with the same longitudinal length a and transverse length b each and with the same gap width p.

Generally, the emission characteristic of the FED cathode is not uniform within the cathode area but different due to such an influence as production process. Thus, even if the same driving voltage is applied to all the gates and cathodes, current obtained therefrom is different depending on a position in the cathode area, so that luminance unevenness is produced on a display screen. To solve this problem, usually the luminance unevenness is eliminated by correcting the level of displayed data on a driving circuit side. However, a driver IC capable of displaying its gradient is necessary for this purpose.

Further, in the FED for performing full-color representation, it is necessary to achieve color balance for each luminous color in addition to the problem that emission current is different. Thus, if data of each luminous color is corrected by means of a driving circuit, a part of the gradient displaying capacity is used for this correction, so that substantially the number of luminous colors decreases.

SUMMARY OF THE INVENTION

Accordingly, an object of the present invention is to reduce luminance unevenness of the FED by construction means and correct white balance of the full-color FED.

According to the present invention, to solve the above-described problem, there is provided a field emission display (FED) wherein a plurality of field emission cathodes having cathode wirings, emitter cones for emitting electrons, and resistance layers each formed between the cathode wiring and the emitter cones are formed on the cathode area of a cathode substrate, the resistance value of resistance inserted in series between the cathode wiring and the emitter cones being defined by the resistance layer to a value depending on the position thereof in the cathode area.

According to further aspect of the present invention, there is provided a field emission display including: field emission arrays each including a stripe-shaped cathode wiring formed in the cathode area on a cathode substrate; cut-through sections formed in the area of the cathode wiring; island-shaped electrodes formed in the cut-through section; resistance layers formed on the cathode wiring, the cut-through sections and the island-like electrodes; and a plurality of emitter cones formed on the resistance layer corresponding to the island-like electrode; the distance between each of the cut-through sections and the island-like electrode therein being determined depending on the position thereof in the cathode area.

According to still further aspect of the present invention, there is provided a full-color field emission display comprising: field emission arrays each having a stripe shaped cathode wiring formed in the cathode area on a cathode substrate, cut-through sections formed in the area of the cathode wiring, island-shaped electrodes formed in the cut-through section, resistance layers formed on the cathode wiring, the cut-through sections and the island-like electrodes, and a plurality of emitter cones formed on the resistance layer corresponding to the island-like electrode; an anode electrode disposed on the cathode substrate opposite thereto with a specified gap having stripe shaped anode electrodes formed thereon; and phosphor dots each coated at a position on the anode electrode corresponding to each of the field emission array, for emitting one of three basic colors of light, a distance between the island-like electrode and the cut-through section in each of the field emission array being determined to be a specified distance depending on the luminous color of a corresponding phosphor dot so as to achieve white balance.

The present invention as defined in the claims can be better understood with reference to the text and to the following drawings as follows:

DESCRIPTION OF THE PREFERRED EMBODIMENTS

Figure 1A:
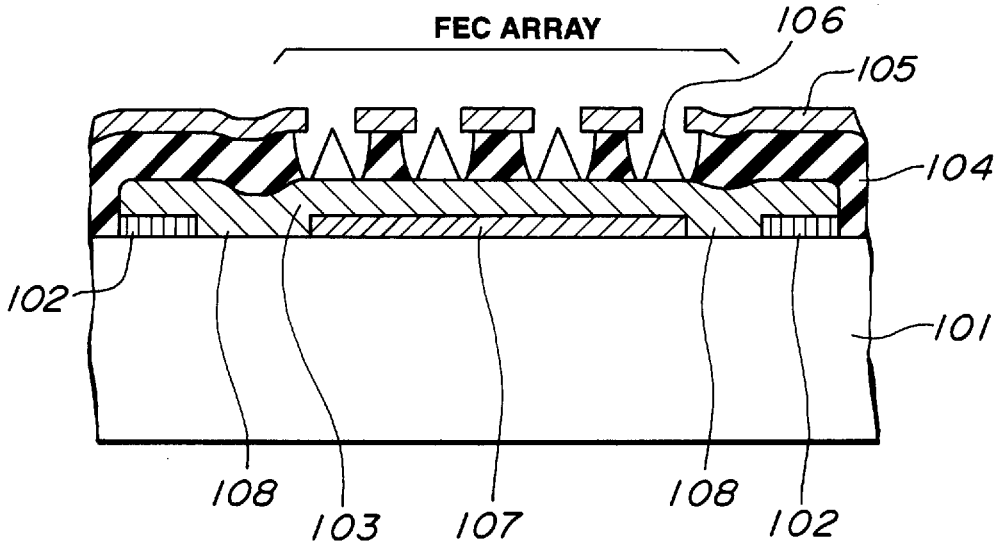
FIG. 1 is a diagram for explaining an FEC array having conventional island construction electrodes.
Figure 1B:
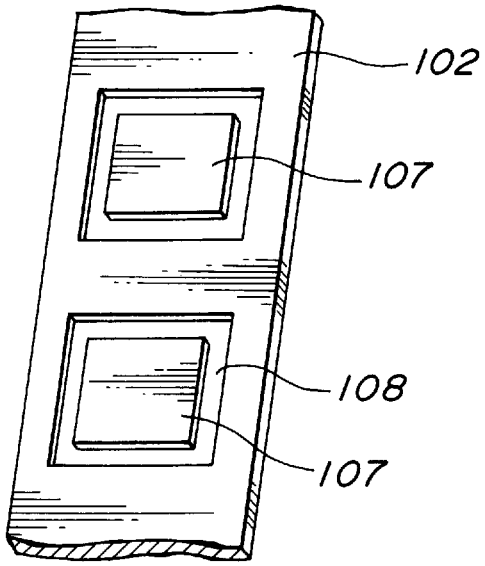
Figures 2, 2A:
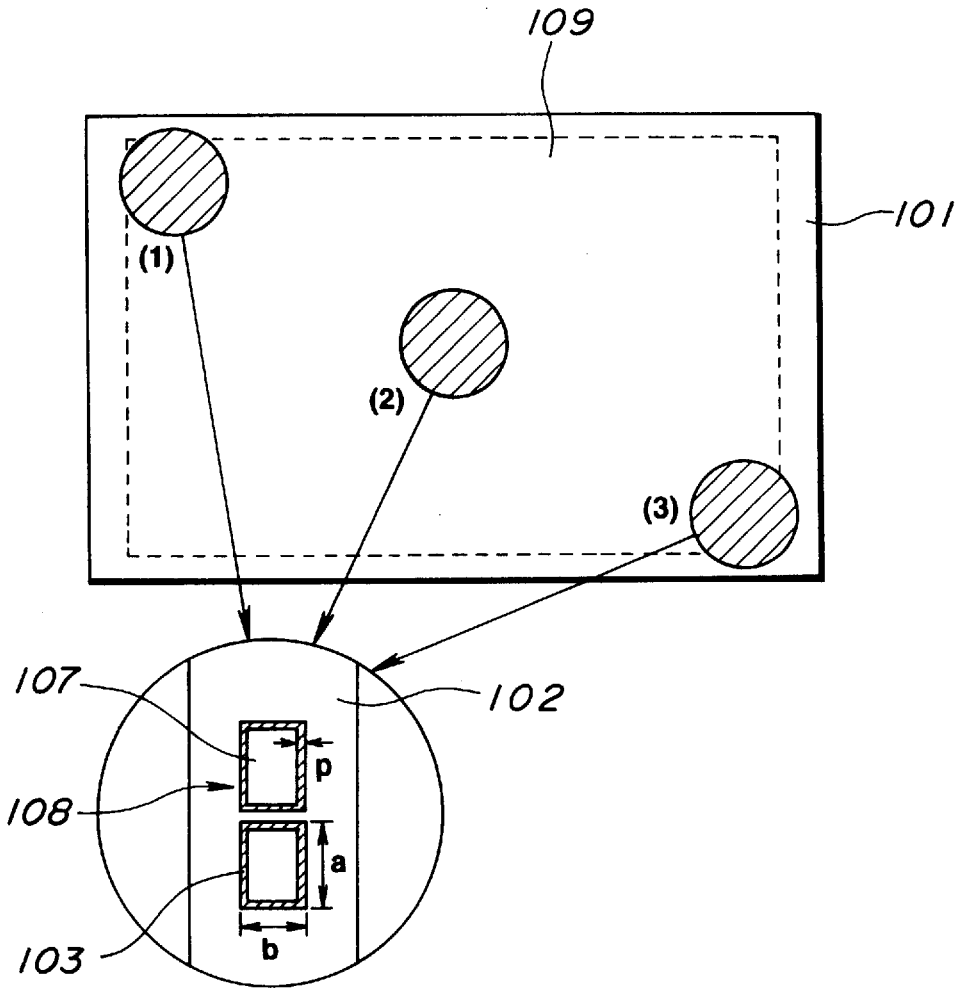
FIG. 2 is a diagram for showing a construction of a cathode substrate of a conventional field emission display.
Figures 3, 3A, 3B, 3C:
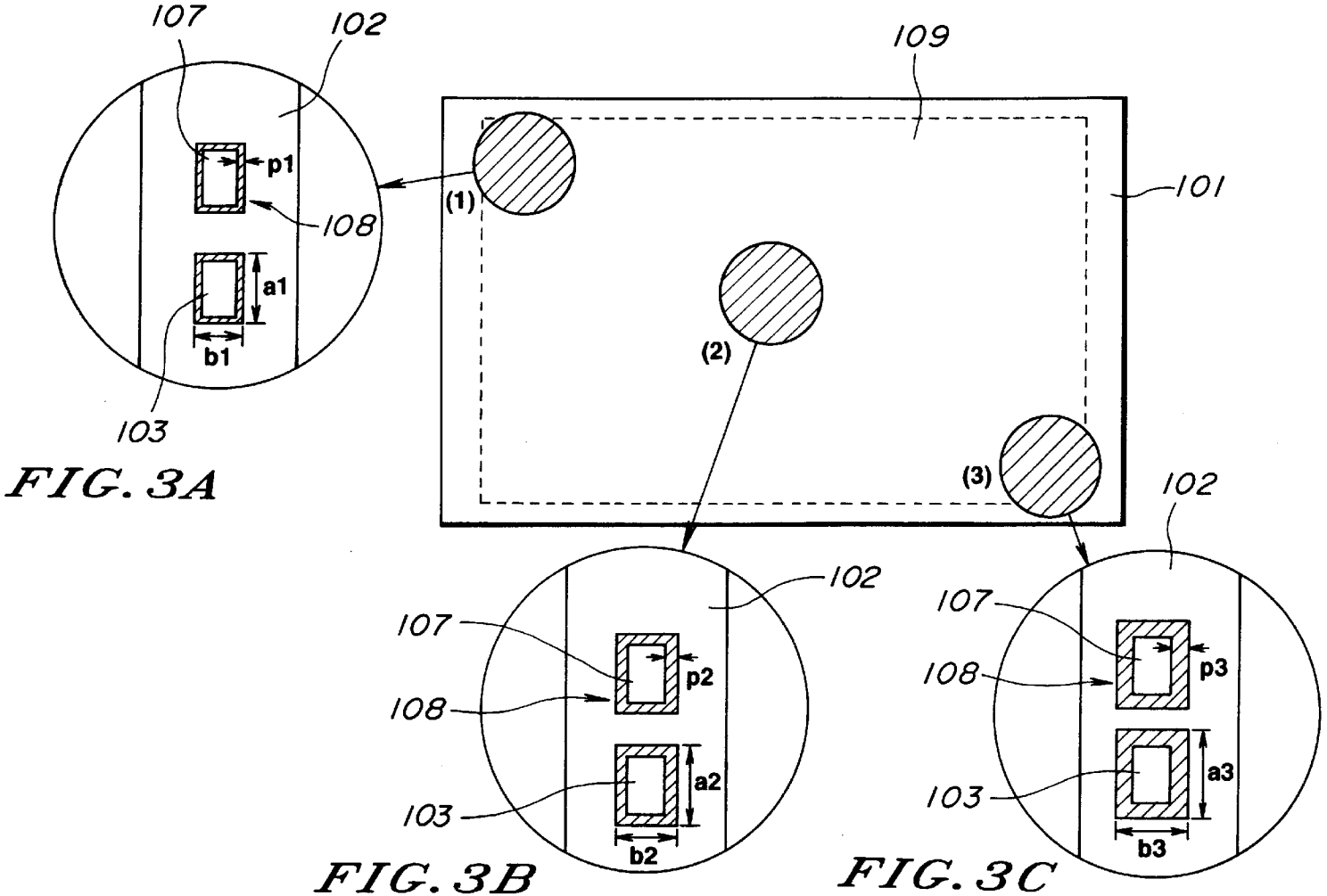
FIG. 3 is a diagram for showing a construction of a cathode substrate according to an embodiment of the field emission display of the present invention.

FIG. 3 shows the top view of an FED cathode according to the first embodiment of the present invention. Referring to this Figure, reference numeral 101 denotes a cathode substrate, numeral 102 denotes a cathode wiring, numeral 107 denotes an island-like electrode, numeral 108 denotes a cut-through section and numeral 109 denotes a cathode area. They are the same as in the conventional technology described above. However, according to the first embodiment of the present invention, longitudinal and transverse dimensions a and b of the cut-through section 108 formed in an area of the cathode wiring 102 vary depending on the position thereof on the cathode area 109, and a gap width p between each cathode wiring 102 and each island-like electrode 107 varies depending on the position of the cathode wiring 102 on the cathode area 109. At the top left portion (1) of the cathode area 109, as shown in this Figure, the longitudinal and transverse dimensions of the cut-through section 108 are specified to be a1 and b1 respectively and the gap width thereof is specified to be p1. Further, in the central portion (2), the gap width is specified to be p2 and in the bottom right portion, the gap width is specified to be p3.

As described above, by changing the gap width, the resistance to be inserted between an emitter cone 106 and the cathode wiring 102 can be changed, so that the magnitude of emission current from the FEC array can be determined. Thus, by determining the gap width p so as to eliminate difference of emission current depending upon a position of the cathode wiring 102 on the cathode area 109, luminance irregularity can be eliminated.

Figures 4A, 4B, 4C, 4D:
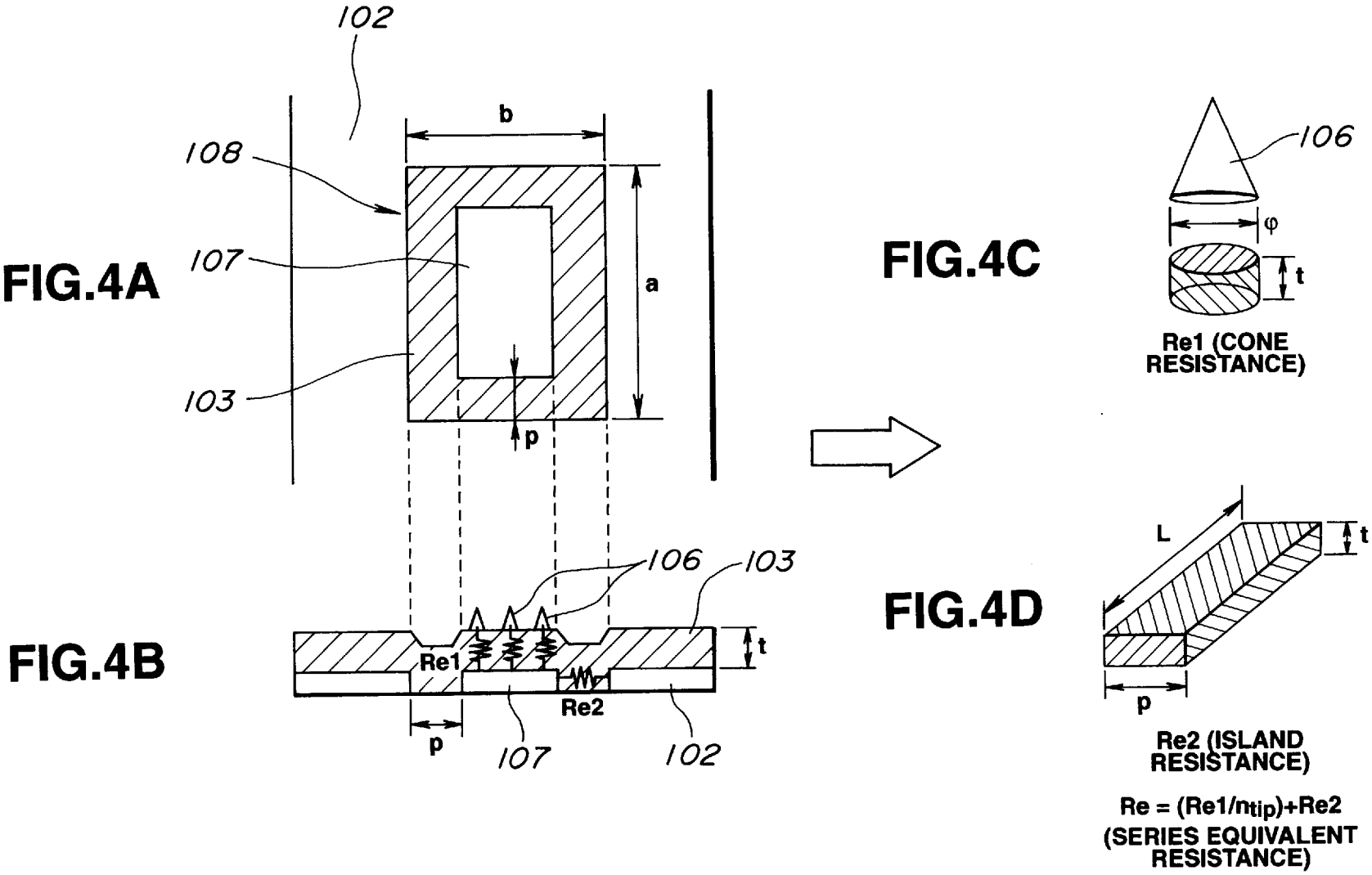
FIG. 4 is a diagram for explaining a resistance inserted between an emitter cone and a cathode wiring.

Referring to FIG. 4, this invention will be explained more in detail. FIG. 4A is a top view of the island construction cathode and FIG. 4B is a sectional view thereof. As shown in FIG. 4A, the longitudinal and transverse dimensions of the cut-through section 108 in the cathode electrode 102 are assumed to be a and b respectively and the gap width between the island-like electrode 107 and the cathode wiring 102 is assumed to be p. Series equivalent resistance Re formed by resistance layer 103 having thickness t, disposed between the emitter cone 106 formed above the island-like electrode 107 and the cathode wiring 102 can be, as shown in FIG. 4B, divided into a resistance (referred to as cone resistance) Re1 formed between each emitter cone 106 and the island-like electrode 107 by the resistance layer 103 disposed between each emitter cone 106 and the island-like electrode 107, and a resistance (referred to as island resistance) Re2 formed by the resistance layer 103 disposed in the cut-through section 108 between the island-like electrode 107 and the cathode wiring 102. FIG. 4C is an illustration for explaining this cone resistance Re1 and FIG. 4D is an illustration for explaining the island resistance Re2.

Generally, resistance R formed by a resistance film having a volume resistivity ρ·(Ω·cm) is represented in the following expression.

R=ρ·L/A (where A is electrode facing area and L is a length of the electrode)

Therefore, the aforementioned cone resistance Re1 can be expressed where the film thickness of the resistance layer 103 is t and the diameter of the bottom face of the emitter cone 106 is ϕ.

$$Re1=\rho\cdot t/\{\pi\cdot(\phi/2)^2\}$$

Additionally, the aforementioned island resistance Re2 can be expressed as follows.

$$\begin{aligned} Re2 &= \rho\cdot p/(t\cdot L) \\ &= \rho\cdot p^2/[t\cdot\{a\cdot b-(a-2p)\cdot(b-2p)\}] \end{aligned}$$

Thus, if ntip emitter cones 106 are formed on a single island-like electrode 107, the resistance value of series equivalent resistance Re applied to a single island-like electrode 107 is a sum of a resistance value of the cone resistance Re1 obtained by connecting ntip emitter cones in parallel and a resistance value of the island resistance Re2, and expressed in the following formula.

$$\begin{aligned} Re &= (Re1/n\text{tip})+Re2 \\ &= \rho\cdot[t/\{\pi\cdot(\phi/2)^2\cdot n\text{tip}\}+ \\ &\quad p^2/\{t\cdot\{a\cdot b-(a-2p)\cdot(b-2p)\}\}] \end{aligned}$$

Then, voltage drop Vdrop due to this series equivalent resistance Re is expressed in the following formula.

$$\begin{aligned} V\text{drop} &= (I\text{tip}\cdot n\text{tip})\cdot Re \\ &= I\text{island}\cdot Re \end{aligned}$$

where Itip is emission current per emitter cone and Iisland is emission current per island electrode.

Thus, an effective application voltage Vge applied between the gate and the emitter of the FEC is as follows where a gate-cathode voltage applied from a driving circuit is Vgc, Vge=Vgc−Vdrop Thus, the effective application voltage Vge applied between the gate and the emitter depending on the value of the series equivalent resistance Re changes, so that the amount of emission from the FEC can be controlled.

Figure 5:
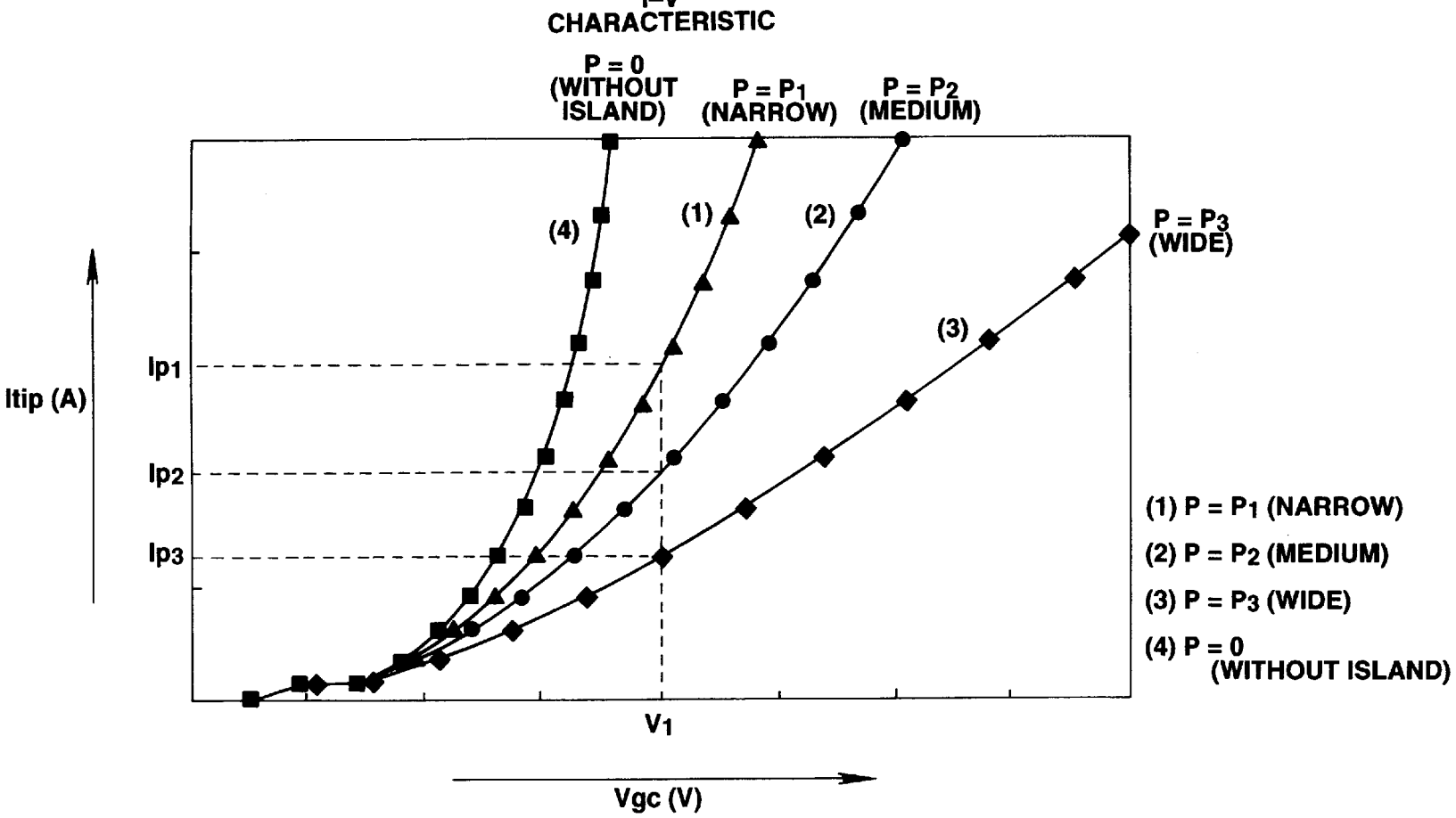
FIG. 5 is a diagram for showing an example of emission characteristic obtained when a distance between an island-like electrode and the cathode wiring is changed.

FIG. 5 shows an example of the Vgc characteristic which is a voltage between the gate and the cathode relative to the emission current Itip per emitter cone when the gap width p is $P_1$, $P_2$, and $P_3$ ($P_1<P_2<P_3$). Because the series equivalent resistance Re decreases as the gap width p decreases as shown in this diagram, so that increased emission current Itip flows with respect to the same gate-cathode voltage Vgc. Meanwhile (4) in this diagram shows a characteristic obtained when p=0, that is, when the resistance layer 103 is formed on the cathode wiring 102 and the emitter cones 106 are formed thereon without disposing the cut-through section 108 and the island electrode 107.

Figures 6, 6A:
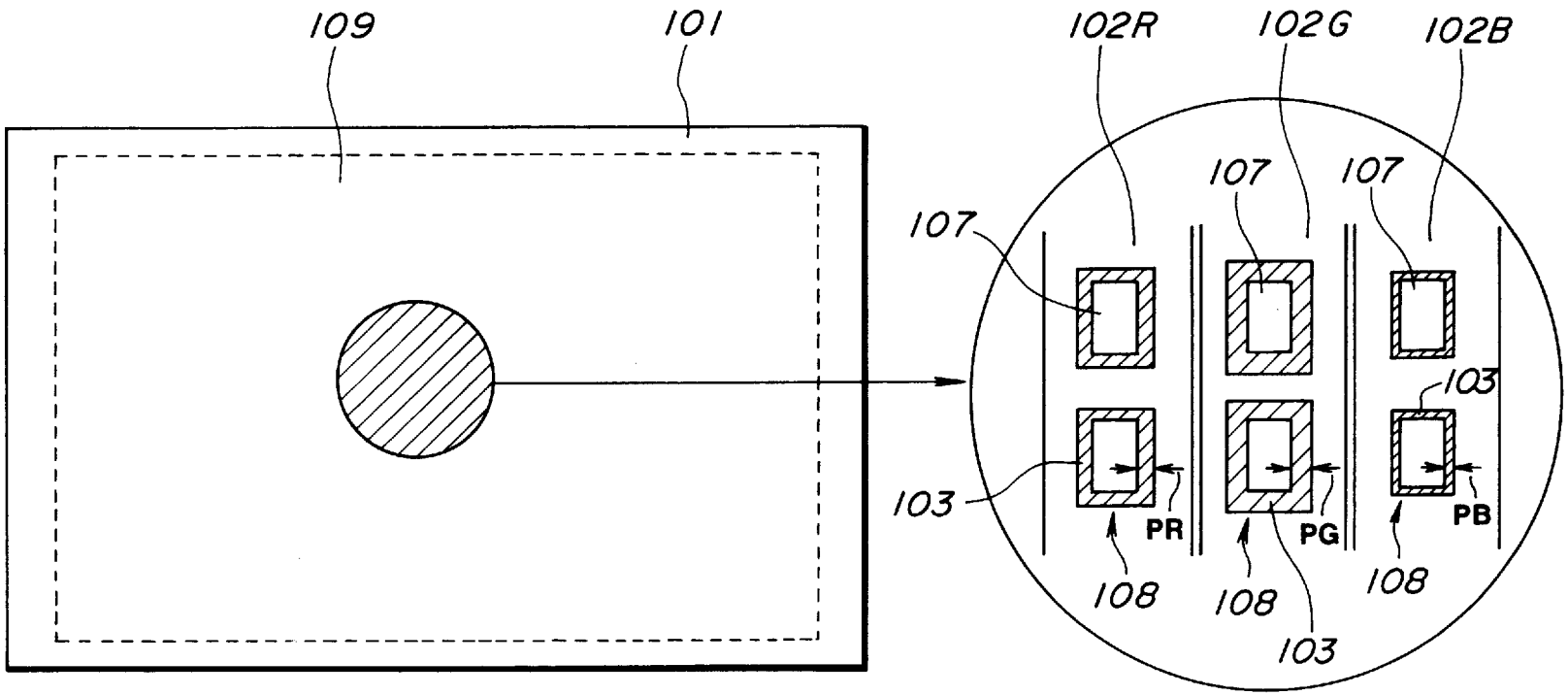
FIG. 6 is a diagram for showing a construction of the cathode substrate in a full-color field emission display according to other embodiment of the present invention.

Next, referring to FIG. 6, the second embodiment of the present invention will be described below. This embodiment relates to an FED for conducting color representation. Referring to FIG. 6, reference numeral 101 denotes a cathode substrate and numeral 109 denotes a cathode area. For example, stripe shaped cathode wirings 102R, 102G and 102B corresponding to three basic colors, red (R) , green (G) and blue (B) respectively are disposed in sequence on this cathode area 109. As described previously, the cathode wirings 102R, 102G and 102B are each supplied with the cut-through sections 108 and in each cut-through section 108, the island-like electrode 107 is formed. As shown in this Figure, a gap width $p_R$ between the island-like electrode 107 in the cathode wiring 102R corresponding to R color and the cathode wiring 102R, a gap width $p_G$ in the cathode wiring 102G corresponding to G color, and a gap width $p_B$ in the cathode wiring 102B corresponding to B color are disposed with different sizes in the gap width, in this example, with a relationship of $p_B<p_R<p_G$.

Meanwhile, on an anode substrate (not shown) disposed on the cathode substrate 101 opposite thereto with a specified gap, stripe shaped anode electrodes corresponding to red color, green color, and blue color are arranged in succession so as to face the aforementioned cathode wirings 102R, 102G and 102B, respectively, corresponding to three basic colors. Then, on the stripe shaped anode electrode corresponding to each color, phosphor dots of each corresponding color adhere to the aforementioned island-like electrode 107. As a result, electrons emitted from the emitter cone formed on the resistance layer 103 above each of the island-like electrodes 107 strike the phosphor dots of a corresponding color so as to produce its color, so that full-color representation is achieved.

Generally, the light emission luminance of the phosphor is expressed as follows.

$$Y=\eta\cdot Va\cdot Ia/\pi\cdot Sa$$

where η is the light emission luminance of the phosphor, Va is anode voltage, Ia is anode current and Sa is a luminous area.

As stated previously, the anode current Ia is a function of the voltage Vgc between the gate and the cathode and Ia=f(Vgc).

Generally, the relation between white balance and luminance is expressed as follows.

$$x=\{xr\cdot(Yr/yr)+xg\cdot(Yg/yg)+xb\cdot(Yb/yb)\}/\{(Yr/yr)+(Yg/yg)+(Yb/yb)\}$$

$$y=(Yr+Yg+Yb)/\{(Yr/yr)+(Yg/yg)+(Yb/yb)\}$$

$$Y=Yr+Yg+Yb$$

where x, y: chromaticity of white color, xr, yr: x, y chromaticities of red color phosphor, xg, yg: x, y chromaticities of green color phosphor, xb, yb: x, y chromaticities of blue color phosphor, Y: light emission luminance of white color, Yr: light emission luminance of red color phosphor, Yg: light emission luminance of green color phosphor, Yb: light emission luminance of blue color phosphor.

Thus, by determining the gap widths $p_R$, $p_G$, $p_B$ in the cathode wirings 102R, 102G and 102B, respectively, corresponding to the respective luminous colors based on the above mentioned formula, in order to obtain specified white color chromaticity and luminances for setting the light emission luminances Yr, Yg and Yb of the luminous bodies of the respective colors, it is possible to achieve a representation with excellent white balance even if respective FEC arrays corresponding to RGB are driven by the same driving voltage.

Although in the above stated embodiments, the resistance disposed in series between the emitter cone 106 and the cathode wiring 102 is controlled by changing the gap width p between the island-like electrode 107 and the cathode wiring 102, the present invention is not restricted to this form, but it is possible to obtain this resistance by the other methods. This will be explained with reference to FIG. 5.

Figure 7A:
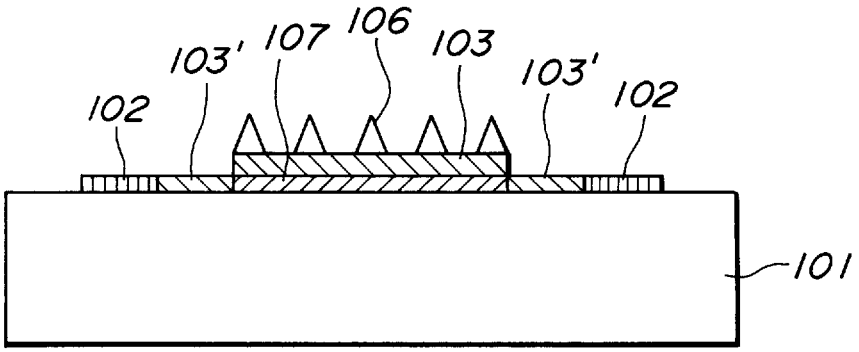
FIG. 7 is a diagram for explaining further embodiment of the present invention.

FIG. 7A shows a method in which the resistance is changed by changing the volume resistivity ρ of a resistance layer. In this Figure, the cathode substrate 101, the cathode wiring 102 and the island-like electrode 107 are the same as those mentioned previously. The resistance layer 103 is formed above the island-like electrode 107 in the aforementioned manner and a plurality of the emitter cones 106 are formed on the resistance layer 103. Then, according to this method, a resistance layer 103' having a volume resistivity ρ different from the aforementioned resistance layer 103 is formed in the cut-through section between the cathode wiring 102 and the island-like electrode 107 and the volume resistivity ρ of the resistance layer 103' is determined to be a specified value, depending on the position in which the appropriate FEC array is formed or a corresponding luminous color. According to this construction, it is possible to set the resistance value of a resistance to be inserted in between the emitter cone 106 and the cathode wiring 102 without changing the dimensions of the cut-through section, unlike in the above-mentioned embodiments.

Figure 7B:
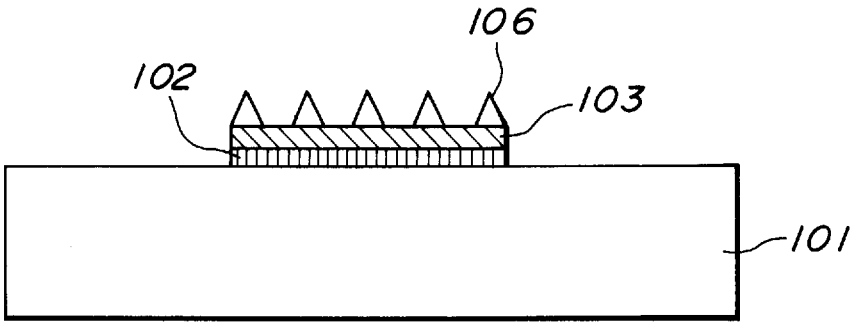

FIG. 7B shows a method in which the cut-through section 108 and the island-like electrode 107 are not formed. In FIG. 7B, reference numeral 101 denotes a cathode substrate, numeral 102 denotes a cathode wiring, numeral 103 denotes a resistance layer and numeral 106 denotes an emitter cone. In a case shown by this Figure, the cut-through section and the island-like electrode are not disposed and the resistance layer 103 is formed on the cathode wiring 102 and a plurality of the emitter cones 106 are formed on the resistance layer 103. Then, the thickness or the resistance value of the appropriate resistance layer 103 are set to be a specified value each depending on the position in which the appropriate FEC array is formed or a corresponding luminous color.

Figure 7C:
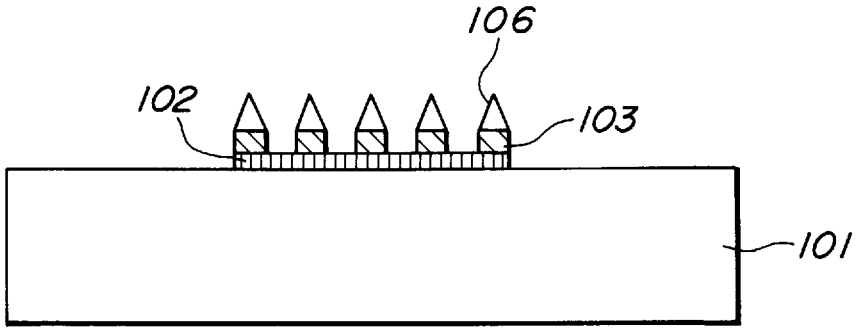

Further, FIG. 7C shows a method in which according to the method shown in FIG. 7B, the resistance layer 103 is formed only below the emitter cone 106.

According to the field emission display of the present invention in which the resistance value of a resistance inserted in series between the emitter cones and the cathode wiring by the resistance layer disposed between the emitter cones and the cathode wiring differs depending on the position thereof in the cathode area, it is possible to reduce deviations of the emission characteristic of the FEC by construction means thereby providing a field emission display having a uniform display characteristic in the luminous plane.

Further, according to the present invention in which the cut-through section is disposed in the area of the cathode wiring and the distance between the cathode wiring and the island-like electrode is changed depending on the position thereof in the cathode area in the field emission array having island construction cathode comprising the cut-through section and the island-like electrode, it is possible to reduce deviation of the emission characteristic of the FEC so as to provide a field emission display not subjected to luminance unevenness in the luminous plane.

Still further, according to this invention in which the distance between the island-like electrode and the cathode wiring in each field emission array is defined to be a specified distance depending on a corresponding display color in the full-color field emission display in which each field emission array having the island construction cathode and an anode phosphor dot are formed one to one, it is possible to correct white balance by construction means so as to realize high quality luminance.

What is claimed is:

1. A field emission display wherein a plurality of field emission cathodes having cathode wirings, groups of emitter cones for emitting electrons, and resistance layers each formed in series between a respective of one of said cathode wirings and a respective one group of said emitter cones are formed on the cathode area of a cathode substrate, the resistance value of each respective resistance layer between said one respective cathode wiring and said one respective group of emitter cones being dependent on the position of said one respective group of emitter cones in said cathode area.

2. A field emission display including: field emission arrays each comprising:

a stripe shaped cathode wiring formed in the cathode area on a cathode substrate;

cut-through sections formed in the area of said cathode wiring;

island electrodes disposed separate from said cathode wiring and formed inside said cut-through section;

resistance layers formed on said cathode wiring, said cut-through sections and said island electrodes; and a plurality of emitter cones formed on said resistance layer corresponding to said island electrode;

the distance between each of said cut-through sections and said island electrode therein being determined depending on the position of said cut-through sections in said cathode area.

3. A full-color field emission display comprising:

field emission arrays each having: a stripe shape cathode wiring formed in the cathode area on a cathode substrate; cut-through sections formed in the area of said cathode wiring; island electrodes disposed separate from said cathode wiring and formed inside said cut-through section; resistance layers formed on said cathode wiring, said cut-through sections and said island electrodes; and a plurality of emitter cones formed on said resistance layer corresponding to said island electrode;

an anode electrode disposed on said cathode substrate opposite thereto with a specified gap having stripe shaped anode electrodes formed thereon; and phosphor dots each coated at a position on said anode electrode corresponding to each of said field emission array, for emitting one of three basic colors of light;

the distance between said island electrode and said cut-through section in each of said field emission array being a predetermined distance depending on the luminous color of a corresponding phosphor dot.

* * * * *